US007537805B2

(12) United States Patent
Naruse et al.

(10) Patent No.: US 7,537,805 B2
(45) Date of Patent: May 26, 2009

(54) METHOD FOR PRODUCING COATED ARTICLE

(75) Inventors: Yasuhito Naruse, Shizuoka (JP); Kenji Hayashi, Shizuoka (JP); Manabu Hashigaya, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 312 days.

(21) Appl. No.: 11/384,494

(22) Filed: Mar. 21, 2006

(65) Prior Publication Data

US 2006/0216423 A1 Sep. 28, 2006

(30) Foreign Application Priority Data

Mar. 22, 2005 (JP) ..... 2005-082406
Mar. 9, 2006 (JP) ..... 2006-064736

(51) Int. Cl.

*B05D 1/00* (2006.01)
*B05D 7/00* (2006.01)
*B05D 3/00* (2006.01)
*B41F 1/18* (2006.01)
*B41F 23/04* (2006.01)

(52) U.S. Cl. ..... 427/424; 427/290; 427/331; 427/372.2; 427/384; 101/130; 101/450.1; 101/453; 101/483; 101/487

(58) Field of Classification Search ..... 101/130, 101/141, 450, 453, 459, 219, 483; 427/289, 427/290, 299, 307, 327, 327.2, 388.1, 398.5, 427/422, 331, 248.1, 457, 446
See application file for complete search history.

(56) References Cited

U.S. PATENT DOCUMENTS 5,643,992 A 7/1997 Northey
2005/0061178 A1 3/2005 Kamitani et al.

FOREIGN PATENT DOCUMENTS

| | | | |
|---|---|---|---|
| JP | 7-89255 A | | 4/1995 |
| JP | 2002-229217 | * | 8/2002 |
| JP | 2005031127 A | | 2/2005 |
| JP | 2005-115357 A | | 4/2005 |
| JP | 2005-116357 A | | 4/2005 |

OTHER PUBLICATIONS

J.D. Cloyd et al.: "Rheological Study of Associative Thickener and latex Particle Interactions" International Waterborne, High-Solids, and Powder Coatings Symposium,Mar. 21, 2001, XP002391543.

* cited by examiner

*Primary Examiner*—Michael Kornakov
*Assistant Examiner*—Francis P Smith
(74) *Attorney, Agent, or Firm*—Sughrue Mion, PLLC

(57) ABSTRACT

In the present invention, a coating liquid satisfies the liquid physical property conditions: (A) in the drying process, after the solid content concentration in the coating liquid is increased to 15% by mass or more by drying the coating film, or after the start of drying when the solid content concentration in the coating liquid is 15% by mass or more at the time of coating; (B) the shear viscosity of the coating liquid becomes 5 mPas or more for the shear rate of $10^3$ $sec^{-1}$ or less; (C) the value obtained through dividing by the average viscosity the first differential coefficient, the increase coefficient of the increase rate of the shear viscosity relative to the increase rate of the solid content concentration is 0.15 or more; and (D) the second differential coefficient, an additional increase coefficient of the increase coefficient relative to the solid content concentration is positive.

2 Claims, 5 Drawing Sheets

METHOD FOR PRODUCING COATED ARTICLE

BACKGROUND OF THE INVENTION

1. Field of the Invention

The present invention relates to a method for producing a coated article, particularly, to a technique in which the coated article is a planographic printing plate produced at least by coating in combination with subsequent drying a photosensitive layer coating liquid on a web on which fine asperities have been formed by surface roughening, and the coating film thickness distribution that tends to affect the sensitivity of the planographic printing plate is suppressed when the coated article is produced.

2. Description of the Related Art

In the production line of a planographic printing plate, while a web (a continuous aluminum support sheet) is being conveyed along the longitudinal direction, a coating film such as a photosensitive layer is formed on the web surface subjected to surface roughening (graining), and the coating film is dried to produce the planographic printing plate.

In this connection, there is a problem that a planographic printing plate, in particular, a multilayer CTP (computer-to-plate) plate exhibits a nonuniform sensitivity when the film thickness distribution of the coating film layer as thin as 1 $g/m^2$ or less is nonuniform. This problem seriously affects the printing plate performance in such a way that non-negligible sensitivity differences are generated even when the film thickness distribution is caused by the asperities on the web surface created by surface roughening. This is described in more detail as follows. As shown in FIG. 5, when two layers, namely, a lower layer 2 and an upper layer 3 are formed on an aluminum support 1, the thickness of the upper layer 3 is such that the film thickness $d_1$ of an upper layer portion 3A associated with a protruded portion 1A of the aluminum support 1 is of the order of 0.14 μm, but the film thickness $d_2$ of an upper layer portion 3B associated with a recessed portion 1B of the aluminum support 1 comes to be of the order of 1.0 μm. Consequently, the printing durability comes to be poor in the upper layer portion 3A in which the film thickness is too thin, and spot defects due to the remaining coating film are caused by the coating film surviving the development treatment in the upper layer portion 3B in which the film thickness comes to be too thick. There is a drawback that the occurrence of such defective portions degrades the production yield. There is also a problem that such a nonuniform film thickness necessitates the coating amount to be set at an amount so as to exceed the appropriate film thickness, resulting in an increase of the cost for the coating liquid.

For the purpose of solving the above described problems, the present inventor has proposed a method in which a coating film is formed along the asperities of the aluminum support by rapidly drying in the drying step the coating film by blowing air against the coating film surface from an air nozzle disposed perpendicularly to the traveling direction of the web (Japanese Patent Application Laid-Open No. 7-89255). However, in the case of Japanese Patent Application Laid-Open No. 7-89255, high pressure air is blown perpendicularly against the coating film surface; consequently, there is a problem that the surface quality of the coating film surface comes to be degraded under the conditions that the coating film is easy to flow owing to the ample amount of the residual solvent as found in the first half of the drying step.

In this connection, the present inventor has proposed, in Japanese Patent Application No. 2003-324462, a method in which the coating film is rapidly dried in the drying step by blowing dry air along the direction parallel to the coating film surface in such a way that the surface quality is not degraded, and consequently, the coating film is formed along the asperities of the aluminum support.

SUMMARY OF THE INVENTION

In any of Japanese Patent Application Laid-Open No. 7-89255 and Japanese Patent Application No. 2003-324462, the leveling effect of the coating liquid at the time of drying is suppressed by rapidly drying through varying the drying conditions including the blowing method of hot air, and the coating film is thereby formed along the asperities of the aluminum support; however, there is a problem that the drying can hardly be controlled depending on the composition differences due to the types of the coating liquids and depending on the conditions involving the line speed of the coating/drying line. Additionally, in the case of an existing drying unit, it comes to be necessary to modify devices such as the air nozzle for blowing hot air to result in increase in cost.

The technique that makes small the film thickness distribution of the coating film by forming the coating film along the asperities of the support is also a technique that can be applied not only to the planographic printing plate but to general coated articles.

The present invention has been achieved in view of these circumstances. Thus, the present invention takes as its object the provision of a method for producing a coated article which method can form a coating film along the asperities on the web surface, and accordingly can make small the film thickness distribution of the coating film, for example, in such a way that when the method is applied to a planographic printing plate, the method can suppress the coating film thickness distribution tending to affect the sensitivity of the printing plate.

A description of the present invention may be made with reference to a planographic printing plate taken as an example as follows: immediately after coating of a coating liquid on a web, the coating film tends to be formed along the asperities of the web surface subjected to surface roughening. However, because the thickness of the coating film is markedly larger than the asperities (usually, of the order of 0.2 to 0.4 μm) of the web surface, the leveling effect of the coating liquid is caused by properties such as the surface tension of the coating liquid. Consequently, the film thickness of each of the coating film portions associated with the protruded portions of the web surface becomes small and the film thickness of each of the coating film portions associated with the recessed portions of the web surface becomes large, so that the film thickness distribution is created in the coating film to degrade the sensitivity of the planographic printing plate.

Accordingly, the present inventor has made an diligent investigation on the possibility that a coating film is formed along the asperities on the web surface subjected to surface roughening by designing a coating liquid having such liquid physical properties that the coating in the coating step is free from trouble and the leveling effect hardly occurs in the drying step. Consequently, there has been obtained a finding that the above described object can be achieved by using a coating liquid that satisfies the following three liquid physical property conditions: the relation between the solid content concentration in the coating liquid to increase in the drying step and the shear viscosity under the conditions of low shear rate (the shear rate of $10^3$ $sec^{-1}$ or less); the value obtained through dividing by the average viscosity the increase coefficient (first differential coefficient) of the increase rate of the shear viscosity relative to the increase rate of the solid content concentration of the coating liquid is 0.15 or more; and the second differential coefficient obtained by further differentiating the increase coefficient takes a positive value. The present invention has been perfected on the basis of such a finding.

For the purpose of achieving the above described object, a first aspect of the present invention is a method for producing a coated article comprising the steps of: applying a coating liquid to a surface of a belt-like web having fine asperities on the surface thereof to form a coating film while the web is being continuously conveyed; and drying the coating film, wherein the coating liquid satisfies the following liquid physical property conditions, (A) in the drying process after the solid content concentration in the coating liquid is increased to 15% by mass or more by drying the coating film in the drying step, or in the drying process after the start of drying in case of the solid content concentration in the coating liquid is 15% by mass or more at the time of coating, (B) the shear viscosity of the coating liquid becomes 5 mPas or more for the shear rate of $10^3$ $sec^{-1}$ or less, (C) the value obtained through dividing by the average viscosity the first differential coefficient, namely, the increase coefficient of the increase rate of the shear viscosity relative to the increase rate of the solid content concentration is 0.15 or more, and (D) the second differential coefficient, namely, an additional increase coefficient of the increase coefficient relative to the solid content concentration is positive.

The occurrence probability of the leveling effect of the coating film in the drying step is inversely proportional to the viscosity of the coating liquid; the larger is the increase rate of the shear viscosity of the coating liquid relative to the increase rate of the solid content concentration in the coating liquid, the more rapidly the viscosity of the coating liquid can be increased in the initial drying stage (before the leveling effect occurs), and the leveling effect can thereby be suppressed.

Accordingly, when a coating liquid satisfying all the liquid physical property conditions (A), (B), (C) and (D) according to the first aspect of the present invention is applied to the belt-like web having the surface subjected to surface roughening and the coating film thus obtained is dried in the drying step, the leveling effect can be suppressed, so that the coating film can be formed along the asperities of the web surface. Consequently, the film thickness distribution of the coating film can be made small. Therefore, when the thus obtained coated article is applied to the planographic printing plate, the sensitivity of the plate can be improved.

A second aspect of the present invention is the method for producing a coated article according to the first aspect, wherein the coated article is a planographic printing plate produced at least by coating in combination with subsequent drying a photosensitive layer coating liquid satisfying the liquid physical property conditions (A), (B), (C) and (D) on a web having the fine asperities formed on the surface thereof by surface roughening.

The present invention is particularly effective when the coated article is a planographic printing plate, and thus the sensitivity of the planographic printing plate can be improved.

As described above, the method for producing a coated article according to the present invention makes it possible to form a coating film along the asperities of a web surface, so that the film thickness distribution of the coating film can be made small. Accordingly, application of the present invention to the production of a planographic printing plate makes it possible, without necessitating modification of the drying unit or use of a specific apparatus, to suppress the thickness distribution of the coating film which distribution tends to affect the sensitivity of the planographic printing plate.

DETAILED DESCRIPTION OF THE PREFERRED EMBODIMENTS

A preferred embodiment for the method for producing a coated article according to the present invention will be described in detail below with reference to the accompanying drawings.

Figure 1:
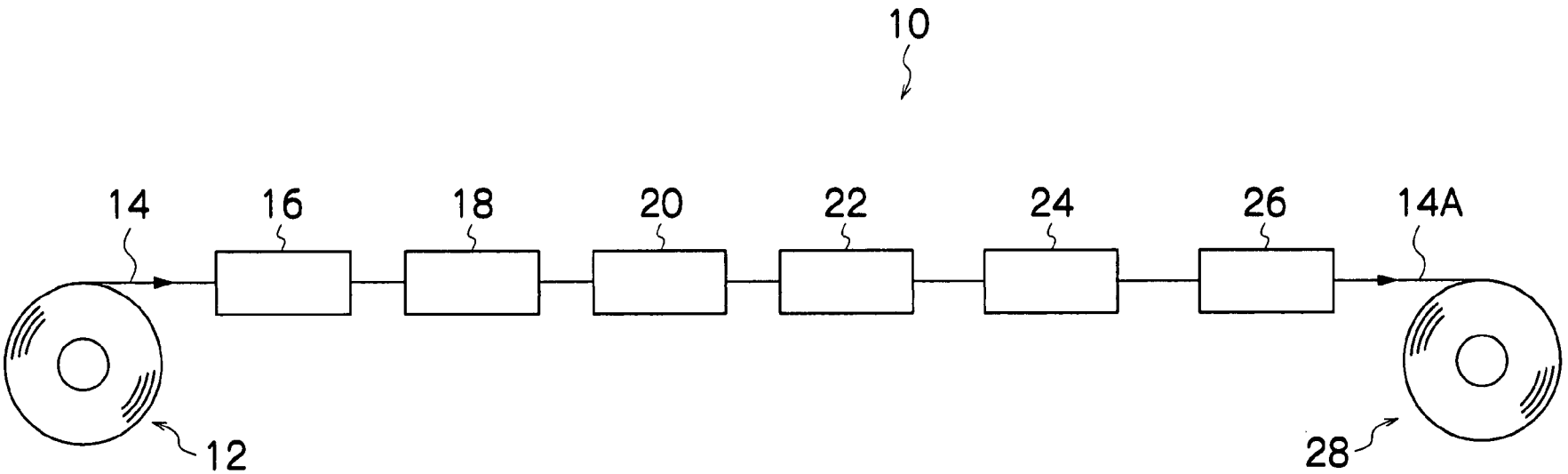
FIG. 1 shows a configuration of the production line of a planographic printing plate to which the present invention is applied.

FIG. 1 shows an example of the production line of a planographic printing plate to which the method for producing a coated article of the present invention is particularly effectively applied. Here, it should be noted that although description will be made in the present embodiment with reference to, as an example, the production of a planographic printing plate, the present invention can be applied to any coated article that requires that the coating be made on a web having fine asperities so as for the film thickness distribution of the coating film to be suppressed.

As shown in FIG. 1, in a feeder 12 installed in a production line 10 of a planographic printing plate, a long sheet web 14 wound in a roll is set. The web 14 having been continuously fed from this feeder 12 is subjected to surface roughening in a brush graining step 16, an etching step 18, an electrolytic graining step 20 and an anodizing step 22. A photosensitive layer is formed on the surface of the web 14 subjected to surface roughening in a photosensitive layer coating/drying step 24, and thereafter, an overcoat layer for preventing damage is formed over the photosensitive layer in an overcoat layer coating/drying step 26. Consequently, a printing plate material 14A for the planographic printing plate is produced, and the printing plate material 14A is once wound by a winder 28. Here, it is to be added that an undercoat layer may be formed between the web 14 and the photosensitive layer. For the purpose of preventing the elution of aluminum at the time of development, a backcoat layer may be formed on the back side (the side opposite to the side on which the photosensitive layer is coated) of the web 14.

In the above described production line 10 of a planographic printing plate, the present invention is applied to the photosensitive layer coating/drying step 24 and the overcoat layer coating/drying step 26.

Figure 2:
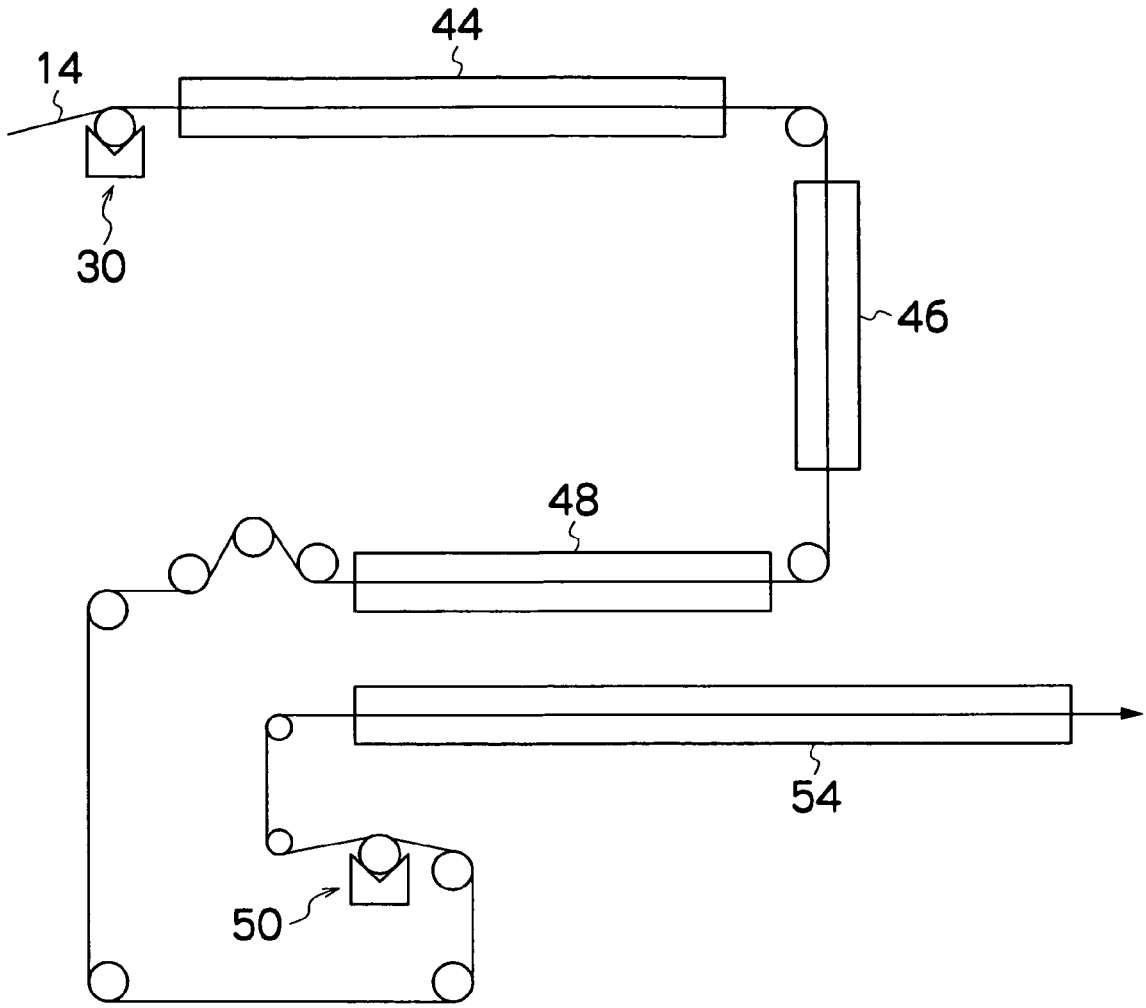
FIG. 2 is a schematic view illustrating the coating/drying line in which a photosensitive layer coating liquid and an overcoat layer coating liquid are applied so as to form two layers.

Specifically, as shown in FIG. 2, a first coater 30 applies a photosensitive layer coating liquid to the surface of the web 14 having been subjected to surface roughening. As such a photosensitive layer coating liquid, a coating liquid designed so as to satisfy the following four liquid physical property conditions is used:

(A) In the drying process after the solid content concentration in the coating liquid is increased to 15% by mass or more by drying the coating film in the drying step, or in the drying process after the start of drying in case of the solid content concentration in the coating liquid is 15% by mass or more at the time of coating;

(B) the shear viscosity of the coating liquid becomes 5 mPas or more for the shear rate of $10^3$ $sec^{-1}$;

(C) the value obtained through dividing by the average viscosity the first differential coefficient, namely, the increase coefficient of the increase rate of the shear viscosity relative to the increase rate of the solid content concentration is 0.15 or more; and (D) the second differential coefficient, namely, an additional increase coefficient of the increase coefficient relative to the solid content concentration is positive. Here, the meaning of that in case of the solid content concentration in the coating liquid is 15% by mass or more at the time of coating includes the case that the solid content concentration in the coating liquid is adjusted 15% by mass or more.

Figure 3:
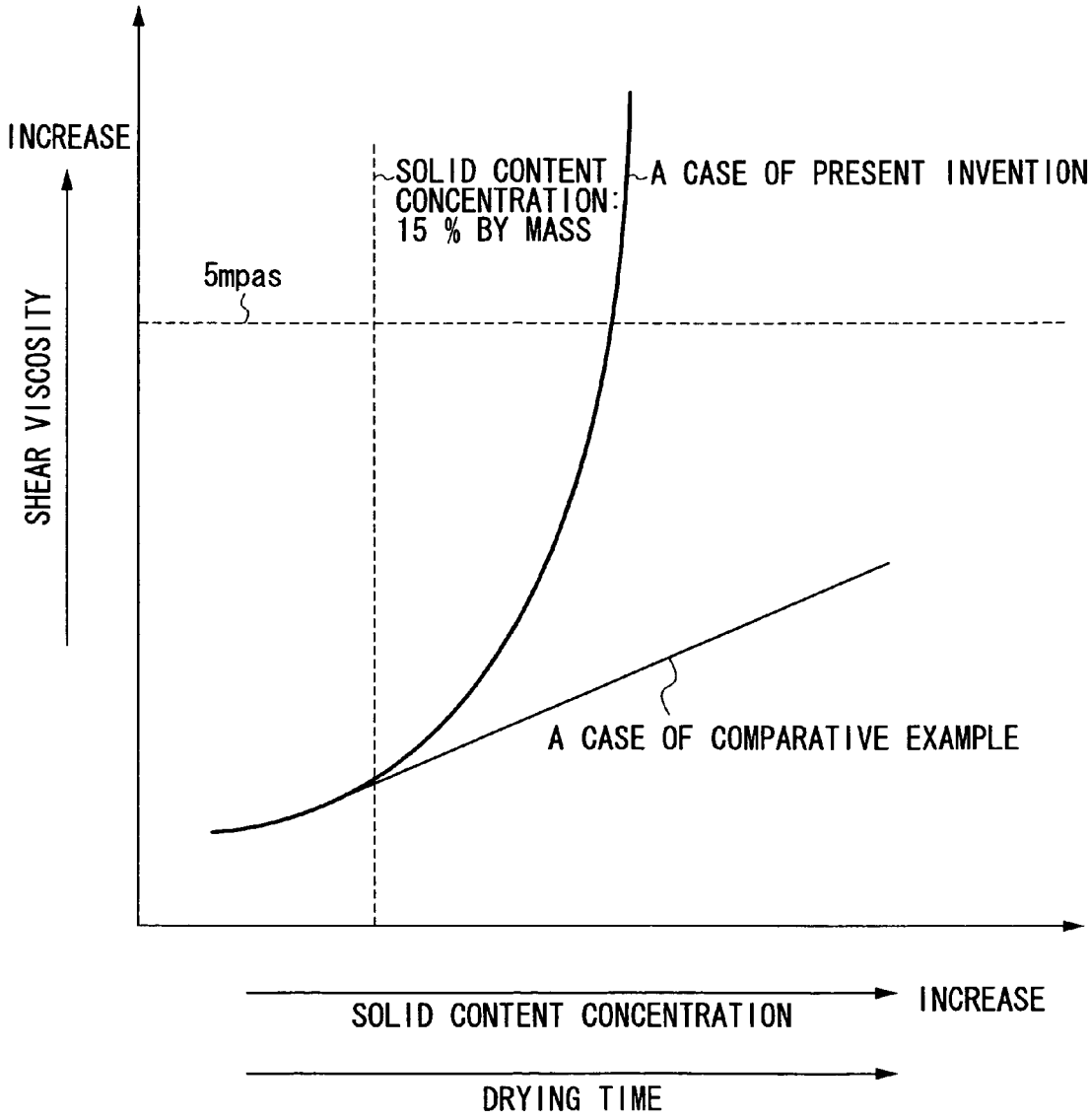
FIG. 3 is a graph showing the relation between the solid content concentration and the shear viscosity, in a drying step, of a coating liquid satisfying the liquid physical property conditions of the present invention.

FIG. 3 is a schematic graph showing an example of the relation between the solid content concentration and the shear viscosity of the photosensitive layer coating liquid of the present invention satisfying the above described four conditions: (A); (B); (C); and (D), under the shear rate condition that the shear rate is $10^3$ $sec^{-1}$ or less. Specifically, the solid content concentration in the photosensitive layer coating liquid dependent on drying or the drying time is taken along the abscissa and the shear viscosity of the photosensitive layer coating liquid is taken along the ordinate; accordingly, in the coating liquid of the present invention in FIG. 3 as described in the above (A) and (B), the shear viscosity of the photosensitive layer coating liquid can be represented as a quadratic curve in which the shear viscosity steeply increases beyond 5 mPas, in the drying process after the solid content concentration in the photosensitive layer coating liquid has been increased to be 15% by mass or more (in case of the solid content concentration in the coating liquid is 15% by mass or more at the time of coating, in other words, namely, at the time of starting the drying if the initial concentration before drying is 15% by mass or more). As described in the above (C) and (D), the steep increase rate of the shear viscosity is defined as the condition that the slope of the tangent of the quadratic curve divided by the viscosity averaged over the interval concerned gives a value of 0.15 or more to be positive. The photosensitive layer coating liquid in the present invention satisfying such liquid physical property conditions as described above can secure the sufficiently low shear viscosity to be free from troubles in the coating step, and can increase the shear viscosity up to such a viscosity that hardly allows the leveling effect of the coating liquid to occur when the solid content concentration is increased by the solvent evaporation in the drying step. Moreover, in certain methods of the coating, the photosensitive layer coating liquid can be applied in the solid content concentration increased to 15% by mass or more.

On the contrary, in the case of a coating liquid having such liquid physical properties that the increase rate of the shear viscosity is small relative to the increase rate of the solid content concentration as in Comparative Example 1 shown in FIG. 3, the leveling effect outstrips the resistance due to the viscosity in the liquid concentrations of 15% by mass or more for which concentrations the shape of the coating film is determined, so that the leveling of the coating liquid comes to be completed.

As shown in FIG. 2, the photosensitive layer coating liquid having such liquid physical properties as described above is applied to the web 14, and thereafter conveyed to a first drying zone 44 to be dried therein.

Figure 4:
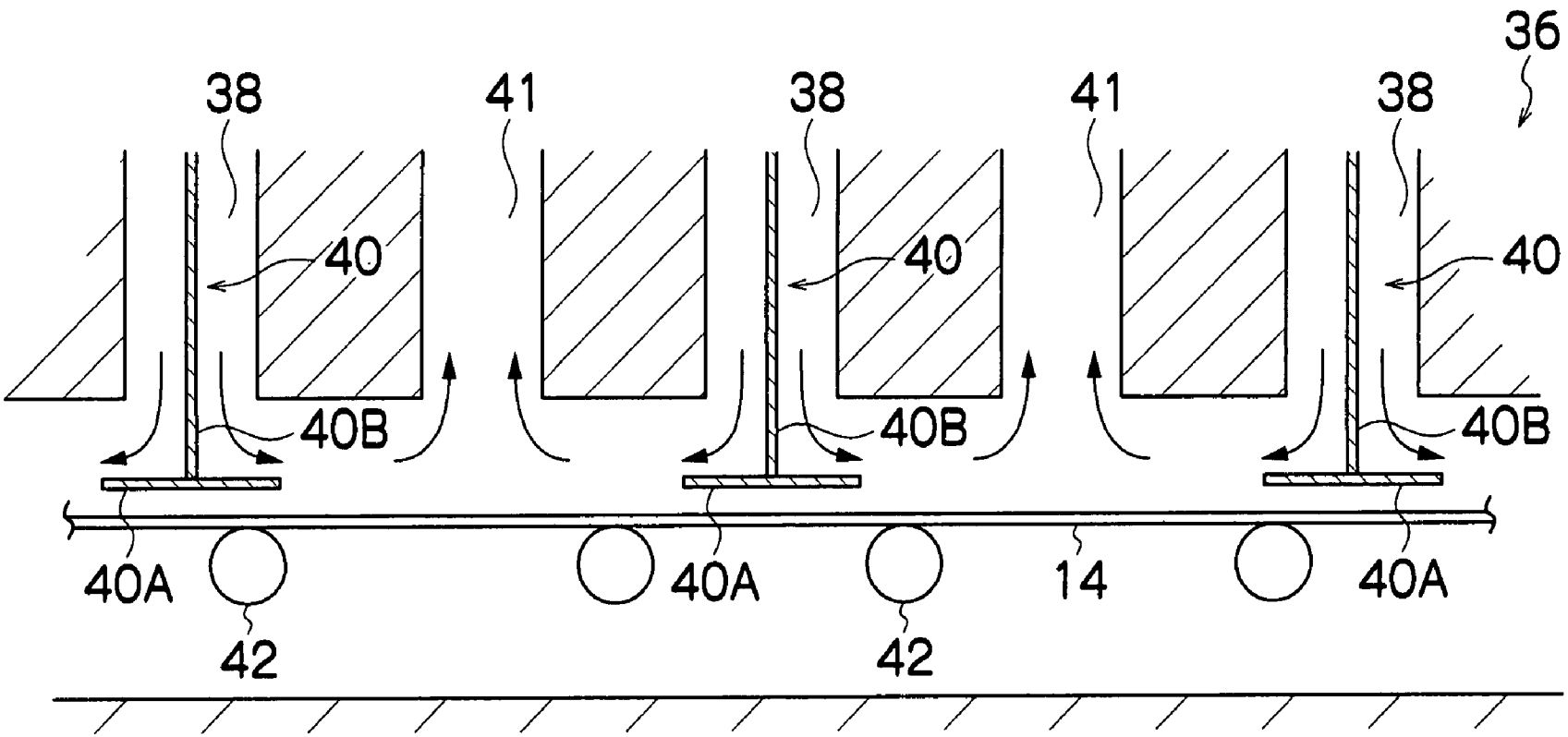
FIG. 4 is a schematic diagram illustrating a parallel flow drying unit in a rapid drying unit.
Figure 5:
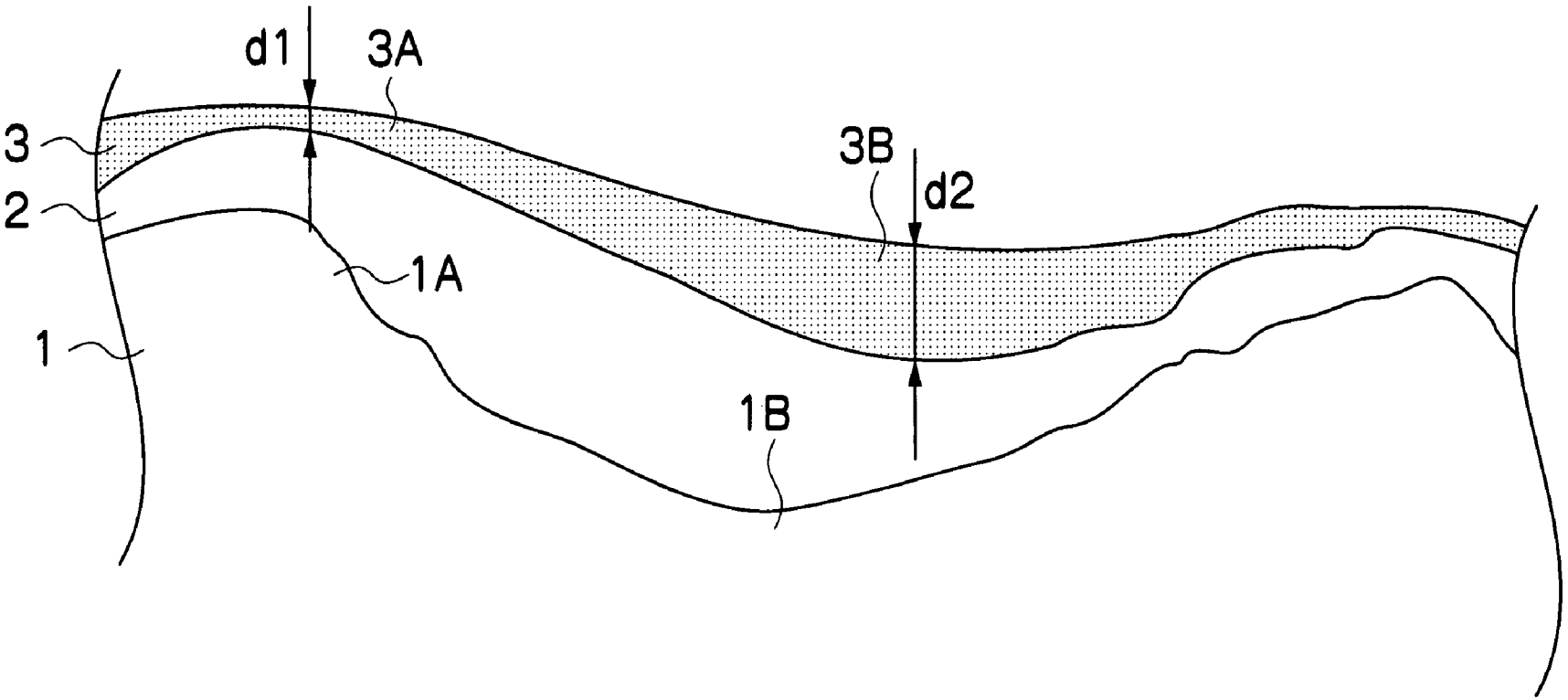
FIG. 5 is a schematic diagram illustrating the film thickness distribution as observed when a coating liquid is applied to a belt-like web having fine asperities on the surface thereof.

The first drying zone 44 is mainly constituted with a parallel flow drying section 36 that dries the coating film with hot air. As shown in FIG. 4, in the parallel flow drying section 36, two or more hot air feed openings 38 and two or more air discharge openings 41 are formed alternately on the coating film side of the web 14 along the traveling direction of the web 14. An inverted T-shaped flow straightening plate 40 is disposed in each of the feed openings 38; the flow straightening plate 40 is constituted with a parallel plate 40A disposed in the vicinity of the coating film surface to be parallel to the coating film surface and with a dividing plate 40B that divides the feed opening 38 into two sections and supports the parallel plate 40A. Accordingly, the hot air blown from the feed opening 38 toward the coating film surface hits against the parallel plate 40A to change the flow course thereof to be divided into the left and right directions so as to be the flows parallel to the coating film surface to flow on the coating film surface. The hot air flowing on the coating film surface is immediately discharged from the air discharge openings 41 accompanied by the solvent evaporated from the coating film surface. Here, reference numeral 42 designates a pas roller to convey and support the web 14.

Accordingly, the photosensitive layer coating liquid satisfying the above described liquid physical property conditions (A), (B), (C) and (D) is increased in viscosity up to such a viscosity that hardly allows the leveling effect to occur, before the leveling effect occurs in the coating film. Consequently, the leveling effect can be suppressed, so that the photosensitive layer can be formed along the asperities on the web surface.

As shown in FIG. 2, the photosensitive layer which has been dried in the first drying zone 44 is forcibly cooled in a first cooling zone 46 and a second cooling zone 48, so that the photosensitive layer formed along the asperities of the web surface is fixed.

Next, if required by the coated article, a second coater 50 applies an overcoat layer coating liquid on the dried photosensitive layer. The overcoat layer coating liquid satisfies the above described liquid physical property conditions (A), (B), (C) and (D) in the same manner as in the photosensitive layer coating liquid, so that the overcoat layer can be formed along the asperities of the web surface by passing the web through a second drying zone 54. As for the second drying zone 54, description will be omitted because it is the same as the first drying zone 44.

As described above, by designing the photosensitive layer coating liquid and the overcoat layer coating liquid so as to satisfy the above described liquid physical property conditions (A), (B), (C) and (D), the coating film can be formed along the asperities of the web surface without necessitating modification of the drying unit or use of any specific unit in an unconventional manner. Consequently, the film thickness distribution of the coating film can be made as small as possible, so that the printing durability failure and the spot defects due to the remaining coating film can be suppressed.

In the present embodiment, both of the coating liquids for the photosensitive layer and the overcoat layer are made to satisfy the above described liquid physical property conditions (A), (B), (C) and (D), but it is also effective to make any one of these coating liquids satisfy the liquid physical property conditions concerned.

EXAMPLE 1

On an aluminum support (web) having the surface thereof subjected to chemical polishing with nitric acid and further to alumite treatment with sulfuric acid so as to have a central line mean roughness Ra of 0.48 μm, the photosensitive layer coating liquid shown in Table 1 and satisfying the above described liquid physical property conditions (A), (B), (C) and (D) (this coating liquid is referred to as the coating liquid of Example 1) was applied so as for the coating amount to be 20 cc/m$^2$.

On an aluminum support having treated in the same manner as above, the photosensitive layer coating liquid that does not satisfy the above described liquid physical property conditions (A), (B), (C) and (D) (this coating liquid is referred to as the coating liquid of Comparative Example 1) was applied so as for the coating amount to be 20 cc/m$^2$.

(An Example of the Coating Liquid Compositions of Example 1)

m,p-Cresol novolac resins (m/p ratio=7/3): 0.35 g

Cyanine dye: 0.019 g

Ethyl methacrylate/isobutyl methacrylate/acrylic acid copolymer (copolymerization ratio=25/60/15): 0.14 g Polymer A (compounds in the following formulas): 0.01 g Polymer B (compounds in the following formulas): 0.01 g Methyl ethyl ketone: 2.716 g 1-Methoxy-2-propanol: 1.163 g (An Example of the Coating Liquid Compositions of Comparative Example 1)

m,p-Cresol novolac resins (m/p ratio=7/3): 0.35 g

Cyanine dye: 0.019 g

Ethyl methacrylate/isobutyl methacrylate/acrylic acid copolymer (copolymerization ratio=45/40/15): 0.14 g Polymer A (compounds in the following formulas): 0.018 g Polymer B (compounds in the following formulas): 0.002 g Methyl ethyl ketone: 2.716 g 1-Methoxy-2-propanol: 1.163 g

[Chemical formula 1]

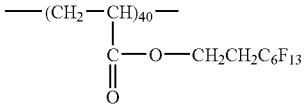

-continued

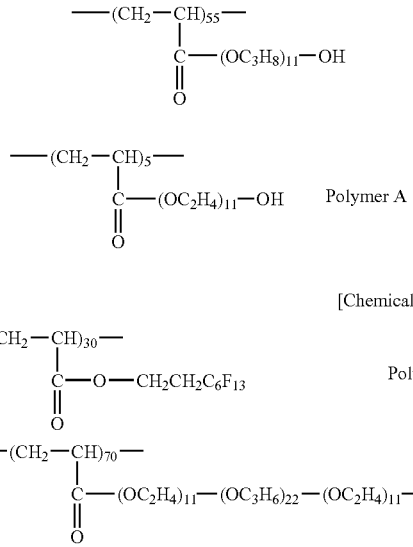

Polymer A

Polymer B

[Chemical formula 2]

Here, it is to be noted that the shear viscosities in Table 1 are the values for the shear rate of $5\times10^2$ sec$^{-1}$.

TABLE 1

| Solid content concentration (X) | Shear viscosity (η) (mPas) | | $\frac{1}{\eta}\cdot\frac{d\eta}{dX}$ | | $\frac{d^2\eta}{d^2X}$ | |
|---|---|---|---|---|---|---|
| (% by mass) | Example 1 | Comp. ex. 1 | Example 1 | Comp. ex. 1 | Example 1 | Comp. ex. 1 |
| 5 | 2 | 2 | 0.08 | 0.08 | 0.8 | 0 |
| 10 | 3 | 3 | 0.182 | 0.057 | 8.4 | 0.6 |
| 15 | 8 | 4 | 0.298 | 0.133 | 143.6 | 2.6 |
| 20 | 55 | 8 | 0.350 | 0.206 | 803 | 0 |
| 25 | 820 | 25 | 0.299 | 0.107 | | |
| 30 | 5600 | 42 | | | | |

As can be seen from Table 1, the coating liquid of Example 1 exhibits a steep increase of the shear viscosity when the solid content concentration in the coating liquid exceeds 15% by mass. Specifically, the shear viscosity takes the values of 55, 820 and 5600 mPas for the solid content concentrations 20%, 25% and 30% by mass, respectively. For the coating liquid of Example 1, in the interval of the solid content concentration between 15 and 20% by mass, the value obtained through dividing by the average viscosity in the above described interval the first differential coefficient, namely, the increase coefficient of the increase rate of the shear viscosity relative to the increase rate of the solid content concentration is 0.298 to be 0.15 or more. Additionally, the second differential coefficient, namely, an additional increase coefficient of the increase coefficient represented by the first differential coefficient relative to the solid content concentration can be seen to increase gradually to be positive with the increase of the solid content concentration.

On the contrary, the coating liquid of Comparative Example 1 exhibits no steep increase of the shear viscosity but a slow increase even when the solid content concentration of the coating liquid exceeds 15% by mass. Specifically, the shear viscosity takes the values of 8, 25 and 42 mPas for the solid content concentrations 20%, 25% and 30% by mass, respectively. For the coating liquid of Comparative Example 1, in the interval of the solid content concentration between 15 and 20% by mass, the value obtained through dividing by the average viscosity in the above described interval the first differential coefficient, namely, the increase coefficient of the increase rate of the shear viscosity relative to the increase rate of the solid content concentration is 0.133 to be less than 0.15. Thereafter, even when the solid content concentration is increased, the increase coefficient is increased to at most 0.206. Additionally, the second differential coefficient, namely, an additional increase coefficient of the increase coefficient represented by the first differential coefficient relative to the solid content concentration can be seen to be zero in some intervals to be nonpositive. The coating liquids of Example 1 and Comparative Example 1, different from each other in the liquid physical properties as described above, each were applied to a web to form a coating film; and the coating films thus obtained were dried under the following three drying conditions (A, B and C) to produce planographic printing plates.

The drying condition A was such that each of the above described coating liquids was applied to a web with a drying rate made sufficiently slow, and thereafter dried slowly over 30 minutes with the wind in a chamber at 28° C. for the purpose of investigating the effects of the liquid physical properties.

The drying condition B was such that the drying was made with a hot air at 80° C. for about 5 minutes in the first drying zone.

The drying condition C was such that the drying was made with a hot air at 120° C. for about 2 minutes in the first drying zone.

The samples of the planographic printing plates produced by drying the coating films under the respective drying conditions were allowed to stand at room temperature until the samples reached room temperature. When the samples reached room temperature, the central line mean roughness Ra of the coating film surface and the printing durability as a planographic printing plate were evaluated for each of the samples. The central line mean roughness Ra of the coating film surface was measured by use of Surfcom manufactured by Tokyo Seimitsu Co., Ltd. with a stylus tip diameter of 2 μm.

The results thus obtained are shown in Table 2. Here, it is to be noted that the central line mean roughness Ra of the aluminum support was 0.48 μm as described above. It was judged that the closer the central line mean roughness Ra of a coating film surface was to the central line mean roughness of the aluminum support, the more suppressed was the leveling effect in the drying step and the coating film was formed to mimic the asperities of the aluminum support. The evaluation of the printing durability is made as follows: a score of 100 is allotted to one of the samples of Example for which the coating liquid satisfying the liquid physical property conditions of the present invention is used and rapidly dried under the drying condition C; and the other samples are evaluated with the scores thereof determined on the basis of the above described score of 100 in such a way that the larger score a sample acquires the more excellent is the sample in printing durability.

TABLE 2

| | Central line mean roughness Ra (μm) | | Test results of printing durability | |
|---|---|---|---|---|
| | Example 1 | Comp. ex. 1 | Example 1 | Comp. ex. 1 |
| Drying condition A | 0.295 | 0.250 | 35 | 25 |
| Drying condition B | 0.305 | 0.270 | 90 | 60 |
| Drying condition C | 0.313 | 0.275 | 100 | 70 |

In the results shown in Table 2, the drying condition A provided insufficient curing of the coating films because of the too low drying temperature to both of Example 1 and Comparative Example 1 resulting in insufficient performances as planographic printing plates.

As can be seen from a comparison of Example and Comparative Example 1 under the drying condition B and the drying condition C, Example 1 was closer to the aluminum support than Comparative Example 1 with respect to the central line mean roughness Ra (μm), so that the coating films of Example were formed along the asperities of the aluminum support. This is also supported by the printing durability evaluation results; Example 1 was superior to Comparative Example 1 in printing durability.

EXAMPLE 2

On an aluminum support (web) having the surface thereof subjected to chemical polishing with nitric acid and further to alumite treatment with sulfuric acid so as to have a central line mean roughness Ra of 0.48 μm, the photosensitive layer coating liquid and satisfying the above described liquid physical property conditions (A), (B), (C) and (D) (this coating liquid is referred to as the coating liquid of Example 2) was applied so as for the coating amount to be 15 cc/$m^2$.

On an aluminum support having treated in the same manner as above, the photosensitive layer coating liquid that does not satisfy the above described liquid physical property conditions (A), (B), (C) and (D) (this coating liquid is referred to as the coating liquid of Comparative Example 2) was applied so as for the coating amount to be 15 cc/$m^2$.

(An Example of the Coating Liquid Compositions of Example 2)

m,p-Cresol novolac resins (m/p ratio=7/3): 0.35 g
Cyanine dye: 0.019 g
Ethyl methacrylate/isobutyl methacrylate/acrylic acid copolymer (copolymerization ratio=25/60/15): 0.14 g
Polymer A (compounds in the following formulas): 0.01 g
Polymer B (compounds in the following formulas): 0.01 g
Methyl ethyl ketone: 1.944 g
1-Methoxy-2-propanol: 0.833 g (An Example of the Coating Liquid Compositions of Comparative Example 2)

m,p-Cresol novolac resins (m/p ratio=7/3): 0.35 g
Cyanine dye: 0.019 g
Ethyl methacrylate/isobutyl methacrylate/acrylic acid copolymer (copolymerization ratio=45/40/15): 0.14 g
Polymer A (same compounds in Example 1): 0.018 g
Polymer B (same compounds in Example 1): 0.002 g
Methyl ethyl ketone: 1.944 g
1-Methoxy-2-propanol: 0.833 g The solid content concentration in the coating liquids of the above Example 2 and Comparative Example 2 is in 16% by mass. Thus, the coating liquid which had the solid content concentration in the coating liquid in 15% by mass or more (16% by mass in Example 2) at the time of coating was applied to a web to form a coating film, and the obtained coating films were dried under the same three drying conditions with Example 1 to produce planographic printing plates.

The results are shown in Table 3.

TABLE 3

| | Central line mean roughness Ra (μm) | | Test results of printing durability | |
|---|---|---|---|---|
| | Example 2 | Comp. ex. 2 | Example 2 | Comp. ex. 2 |
| Drying condition A | 0.297 | 0.251 | 35 | 25 |
| Drying condition B | 0.307 | 0.271 | 90 | 60 |
| Drying condition C | 0.316 | 0.276 | 100 | 70 |

The results obtained in Example 2 as shown in Table 3 are about the same as the results of Example 1 shown in Table 2. Therefore, the same result can be obtained when the coating is performed after the solid content concentration in the coating liquid is increased to 15% by mass or more.

What is claimed is:

1. A method for producing a coated article comprising the steps of:

applying a coating liquid to a surface of a belt-like web having fine asperities on the surface thereof to form a coating film while the web is being continuously conveyed; and drying the coating film, wherein the coating liquid satisfies the following liquid physical property conditions, (A) in the drying process after the solid content concentration in the coating liquid is increased to 15% by mass or more by drying the coating film in the drying step, or in the drying process after the start of drying in case of the solid content concentration in the coating liquid is 15% by mass or more at the time of coating, (B) the shear viscosity of the coating liquid becomes 5 mPas or more for the shear rate of $10^3$ $sec^{-1}$ or less, (C) the value obtained through dividing by the average viscosity a first differential coefficient is 0.15 or more, wherein the first differential coefficient is an increase coefficient of the increase rate of the shear viscosity relative to the increase rate of the solid content concentration, and (D) a second differential coefficient is positive, wherein the second differential coefficient ia an additional increase coefficient of the increase coefficient relative to the solid content concentration.

2. A method for producing a planographic printing plate, the method comprising:

applying a photosensitive layer coating liquid to a surface of a belt-like web having fine asperities formed on the surface thereof by surface roughening, to form a coating film, while the web is being continuously conveyed; and drying the coating film, wherein the coating liquid satisfies the following liquid physical property conditions, (A) in the drying process after the solid content concentration in the coating liquid is increased to 15% by mass or more by drying the coating film in the drying step, or in the drying process after the start of drying in case of the solid content concentration in the coating liquid is 15% by mass or more at the time of coating, (B) the shear viscosity of the coating liquid becomes 5 mPas or more for the shear rate of $10^3$ $sec^{-1}$ or less, (C) the value obtained through dividing by the average viscosity a first differential coefficient is 0.15 or more, wherein the first differential coefficient is an increase coefficient of the increase rate of the shear viscosity relative to the increase rate of the solid content concentration, and (D) a second differential coefficient is positive, wherein the second differential coefficient ia an additional increase coefficient of the increase coefficient relative to the solid content concentration.

* * * * *